US007412974B2

(12) United States Patent
Russell

(10) Patent No.: US 7,412,974 B2
(45) Date of Patent: Aug. 19, 2008

(54) DEVICE FOR ENHANCING FUEL EFFICIENCY OF INTERNAL COMBUSTION ENGINES

(75) Inventor: Raymond B. Russell, Clinton, TN (US)

(73) Assignee: Gas Gorilla, LLC, Knoxville, TN (US)

( * ) Notice: Subject to any disclaimer, the term of this patent is extended or adjusted under 35 U.S.C. 154(b) by 0 days.

(21) Appl. No.: 11/520,372

(22) Filed: Sep. 13, 2006

(65) Prior Publication Data

US 2007/0131198 A1 Jun. 14, 2007

Related U.S. Application Data

(60) Provisional application No. 60/749,576, filed on Dec. 12, 2005.

(51) Int. Cl.
*F02M 33/00* (2006.01)

(52) U.S. Cl. ..... 123/590; 123/306; 123/189.4

(58) Field of Classification Search ..... 123/306, 123/590; 48/189.4
See application file for complete search history.

(56) References Cited

U.S. PATENT DOCUMENTS 1,279,771 A * 9/1918 Snider ..... 48/189.6
2,017,043 A * 10/1935 Galliot ..... 138/40
3,556,065 A 1/1971 Jordan
3,874,357 A 4/1975 List et al.
3,938,967 A * 2/1976 Reissmuller ..... 48/189.4
4,088,104 A * 5/1978 Ibbott ..... 48/189.4
4,177,780 A * 12/1979 Pellerin ..... 123/590
4,180,041 A 12/1979 Miyazaki et al.
4,207,854 A 6/1980 Alford et al.
4,295,458 A 10/1981 Pellerin
4,307,697 A 12/1981 Ong
4,308,832 A 1/1982 Okumura et al.
4,318,386 A 3/1982 Showalter et al.
4,333,441 A 6/1982 Still et al.
4,336,776 A 6/1982 Sumiyoshi et al.
4,366,787 A 1/1983 Gale
4,409,951 A 10/1983 Whitworthl
4,872,440 A * 10/1989 Green ..... 123/590
4,903,993 A 2/1990 Brammer
5,097,814 A 3/1992 Smith
5,301,939 A 4/1994 Ellsworth
5,392,752 A * 2/1995 Brogan et al. ..... 123/591
5,884,598 A 3/1999 Kawashima
6,055,727 A 5/2000 Brignall et al.
6,280,317 B1 8/2001 Przilas et al.
6,550,446 B1 4/2003 Robley, Jr.

(Continued)

OTHER PUBLICATIONS

International Search Report issued in counterpart International Application No. PCT/US06/46989, mailed Oct. 18, 2007.

*Primary Examiner*—Erick Solis
(74) *Attorney, Agent, or Firm*—DLA Piper US LLP

(57) ABSTRACT

An apparatus for enhancing the fuel efficiency of an internal combustion engine includes a generally conical-shaped member positioned in a gas flow generated by the engine. One or more deformations, such as tabs and notches, are formed in the conical member to alter one or more characteristics, such as pressure and velocity, of the gas flow. The apparatus may be positioned in the air intake system. Alternatively, the apparatus may be positioned in the exhaust system.

21 Claims, 5 Drawing Sheets

U.S. PATENT DOCUMENTS

| | | | |
|---|---|---|---|
| 6,604,850 | B1 | 8/2003 | Schneider et al. |
| 6,796,296 | B2 | 9/2004 | Kim |
| 6,837,213 | B1 | 1/2005 | Burnett |
| 2003/0226539 | A1 | 12/2003 | Kim |
| 2005/0035219 | A1 | 2/2005 | Rock |
| 2005/0188969 | A1 | 9/2005 | Wheeler, III |
| 2006/0096573 | A1 | 5/2006 | Jonson |

* cited by examiner

DEVICE FOR ENHANCING FUEL EFFICIENCY OF INTERNAL COMBUSTION ENGINES

REFERENCE TO PENDING APPLICATIONS

This application claims priority to U.S. Provisional Patent Application No. 60/749,576, filed Dec. 12, 2005, and entitled "Fuel Saver".

1. FIELD OF THE INVENTION

The present invention relates to a device for enhancing the fuel efficiency of internal combustion engines.

2. BACKGROUND OF THE INVENTION

The fuel efficiency of an internal combustion (IC) engine depends on many factors. One of these factors is the extent to which the fuel is oxidized prior to combustion. A variety of devices are currently available that attempt to provide better fuel-air mixing by imparting turbulence to the intake air. For example, one class of devices utilizes serpentine geometries to impart swirl to the intake air on the theory that the swirling air will produce a more complete mixing with the fuel. Other devices utilize fins or vanes that deflect the air to produce a swirling effect.

Another factor that effects fuel efficiency is the amount of air that can be moved through the engine. Backpressure in the exhaust system restricts the amount of air that can be input to the engine. Additionally, most IC engines of the spark ignition type employ a so-called "butterfly" valve for throttling air into the engine. But the valve itself acts as an obstruction to air flow even when fully open. It would be desirable, therefore, to improve the fuel-air mixture while also increasing the amount of air flowing into the engine.

Unfortunately, devices that are currently available to enhance an engine's fuel efficiency provide less than satisfactory results. What is needed, therefore, is a low-cost device that can be easily installed into new as well as existing IC engines to effectively enhance fuel efficiency.

BRIEF SUMMARY OF THE INVENTION

The present invention achieves its objectives by providing an apparatus for enhancing a flow of gas generated by an internal combustion engine having an air intake system and an exhaust system. The apparatus may be positioned in the air inlet duct, intake and/or exhaust ports of the cylinder block, or in the exhaust system. The apparatus includes a generally conical-shaped gas flow conditioner having a central axis and a taper angle positioned in the flow of gas. The conditioner includes an inlet for receiving at least a portion of the flow of gas and an outlet in opposed relation to the inlet for outputting at least a portion of the gas received by the inlet. Being of generally conical shape, the circumference of the outlet is smaller than the circumference of the inlet. A wall interconnects the inlet and outlet and includes and inner surface and an outer surface. One or more deformations are formed in the wall to alter one or more characteristics (such as velocity, direction and/or pressure) of the flow of gas.

Deformation of the wall may be accomplished in a variety of ways. For example, a plurality of circumferentially spaced notches may be formed in the wall adjacent the outlet. Preferably, each of the notches includes two edges extending from the outlet toward the inlet. In one embodiment, the edges are substantially parallel and aligned with the central axis of the conditioner. In another embodiment, the edges are offset at an angle relative to the central axis.

Deformation of the wall may also be accomplished by providing a plurality of circumferentially spaced tabs formed in the wall intermediate the inlet and the outlet of the conditioner. Each of the tabs includes a ramp that extends from the wall into the gas flow conditioner to deflect a portion of the gas flowing adjacent the inner surface of the wall.

The conditioner wall may also be deformed by providing a plurality of taper angles from the inlet to the outlet. In a preferred embodiment, the wall includes a first taper angle of about 15 degrees, a second taper angle of about 11 degrees, and a third taper angle of about 16 degrees.

Two or more of the above-described deformations may be incorporated into the conditioner wall with beneficial effect to fuel efficiency.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
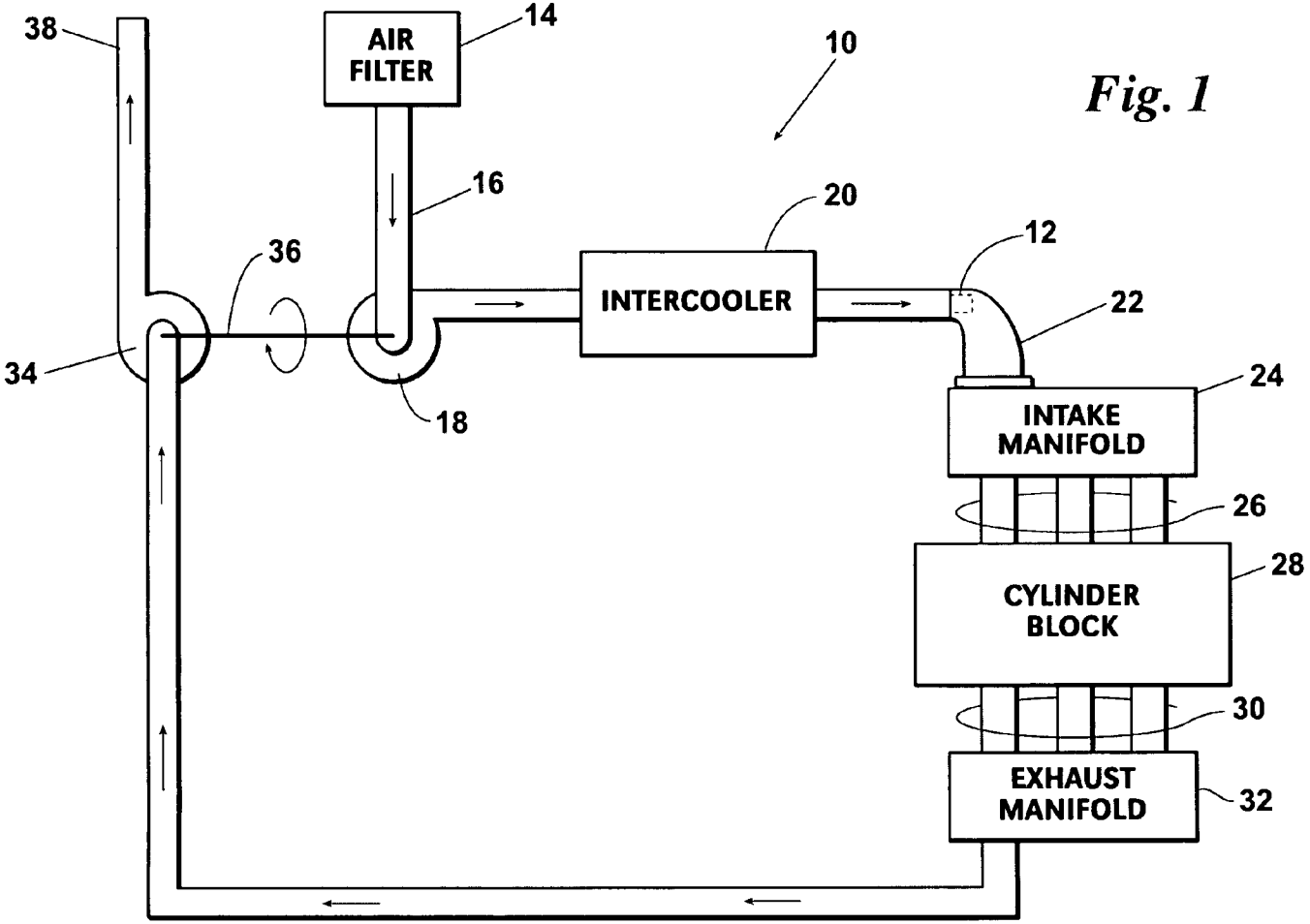
FIG. 1 is a functional block diagram showing a fuel efficiency enhancement device installed in a diesel engine according to the invention.

Turning now to the drawings wherein like reference characters indicate like or similar parts throughout, FIG. 1 illustrates a typical turbo-charged diesel engine 10 having installed therein a fuel efficiency enhancement device, or gas flow conditioner 12, for enhancing a flow of gas generated by an IC engine having an air intake system and an exhaust system. The conditioner is sized to fit inside a duct or other passageway for intake air, a fuel-air mixture, or exhaust. Although FIG. 1 illustrates a particular type of IC engine (i.e., a turbocharged diesel engine), it will be understood that the invention may be employed in other engine types including spark ignition engines. Additionally, while FIG. 1 shows a particular placement of the gas flow conditioner 12, it will be understood that the conditioner 12 can be advantageously positioned at other areas of the engine, as further explained below.

Intake air for the engine 10 passes through an air filter 14 and is conducted through air passage 16 to a turbocharger compressor 18 where the air is compressed. Compressed air exiting turbocharger 18 is passed through an air-to-air intercooler 20 before entering snorkel 22. For the particular application shown in FIG. 1, the cooled air enters snorkel 22 through conditioner 12, which is configured to accelerate the air for better fuel oxidation and throughput. Air exiting snorkel 22 is received by intake manifold 24, which distributes the air through intake passages 26 to the engine cylinder block 28 where the air is mixed with fuel and combusted. Exhaust exits cylinder block 28 through exhaust passages 30 and enters exhaust manifold 32. The exhaust is conducted to a turbocharger turbine 34 which turns shaft 36 to drive compressor 18. After exiting turbine 34, the exhaust is vented to atmosphere through exhaust stack 38.

Figure 2:
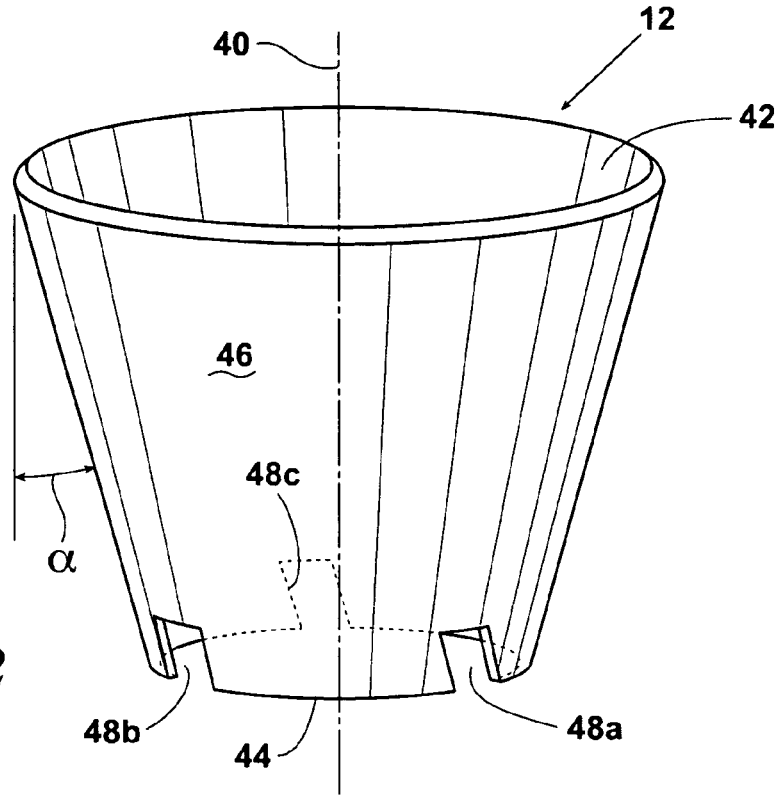
FIG. 2 is a front elevational view of a fuel efficiency enhancement device with notches.

Testing of the conductor 12 has shown that it can be configured in a variety of ways to enhance the fuel efficiency of the engine 10, thereby enabling the engine 10 to operate with increased power and mileage and reduced engine emissions. In one embodiment of the conductor 12 shown in FIG. 2, the conductor 12 is generally conical-shaped with a central axis 40. The conductor 12 includes an inlet 42 for receiving at least a portion of a flow of gas generated by the engine 10 (i.e., inlet air, air-fuel mixture, exhaust). An outlet 44 in opposed relation to the inlet 42 outputs at least a portion of the gas received by the inlet 42. Being of generally conical shape, the circumference of the outlet 44 is smaller than the circumference of the inlet 42. A wall 46 interconnects the inlet and outlet. The taper angle $\alpha$ of wall 46 is preferably in the range of about 10 degrees to about 20 degrees.

In all embodiments described herein, the wall 46 includes one or more deformations for altering one or more characteristics (such as velocity, direction, and pressure) of the flow of gas. For the embodiment of FIG. 2, such deformations are in the form of a plurality of circumferentially spaced notches 48*a-c* formed in the wall 46 adjacent the outlet 44. Preferably, notches 48*a-c* are symmetrically spaced. Notches 48*a-c* are believed to enhance operation of the conductor 12 by imparting swirl and/or other turbulence to the flow of gas.

Figure 3:
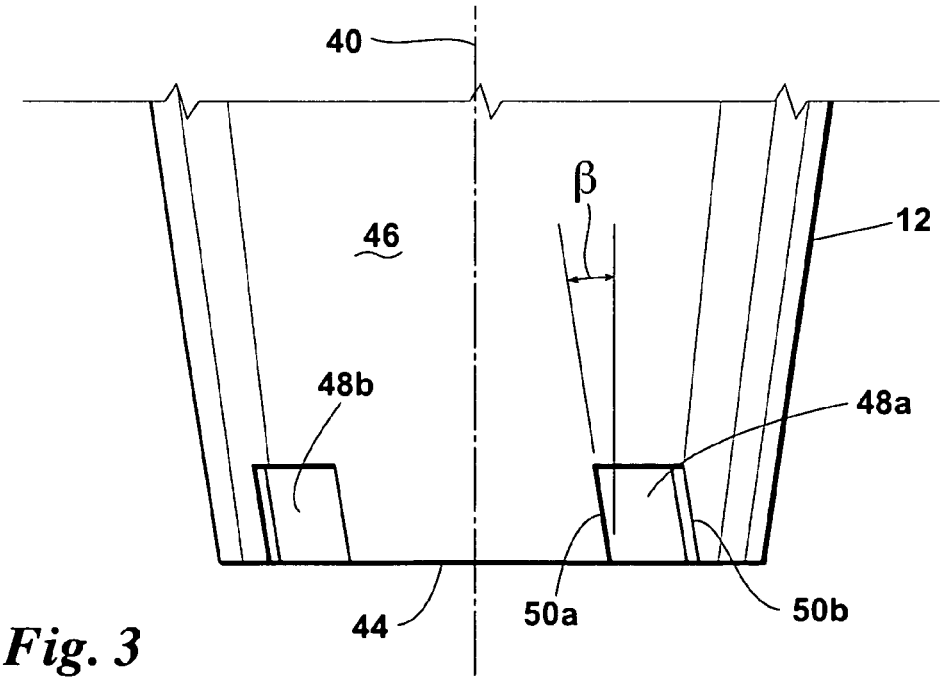
FIG. 3 is a sectional view of the fuel efficiency enhancement device of FIG. 2.

With reference to FIG. 3, each notch 48*a-c* (for clarity, only notches 48*a* and 48*b* are shown in FIG. 3) preferably includes two edges 50*a-b* extending from the outlet 44 toward the inlet 42. Also preferably, the opposed edges 50*a-b* of each notch 48*a-c* are substantially parallel and offset relative to the central axis 40 of the conductor 12 by an angle $\beta$. Edges 50*a-b* can be offset in either a clockwise direction (as shown in FIG. 3) or a counterclockwise direction. Offset angle $\beta$ is preferably about 30 degrees, but may be anywhere within he range of about 25 degrees to about 40 degrees. Alternatively, edges 50*a-b* of each notch 48*a-c* are parallel with central axis 40.

With reference back to FIG. 2, it can be seen that notch 48*c* is angled in a direction opposite to that of notches 48*a* and 48*b*. Testing has shown that reversing one of the notches in this manner further enhances fuel efficiency. However, all of the notches 48*a-c* may be angled in the same direction with beneficial result to fuel efficiency.

Figure 4:
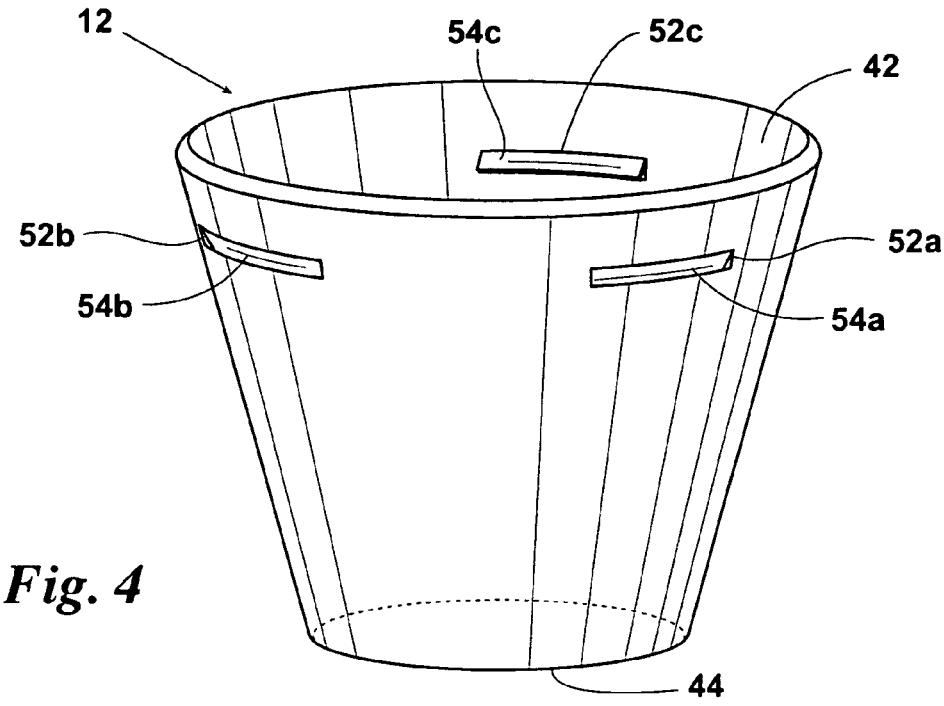
FIG. 4 is a front elevational view of fuel efficiency enhancement device with tabs.

In another embodiment of the conductor 12 shown in FIG. 4, deformation of wall 46 are in the form of a plurality of circumferentially spaced tabs 52*a-c* formed in the wall 46 intermediate the inlet 42 and the outlet 44. Preferably, tabs 52*a-c* are symmetrically spaced. Each of the tabs 52*a-c* includes a ramp 54*a-c* extending from the wall 46 into the conductor 12. Ramps 54*a-c* function to deflect a portion of the gas flowing adjacent the inner surface of the wall 46 and are believed to enhance operation of the conductor 12 by imparting swirl and/or other turbulence to the flow of gas.

Figure 5:
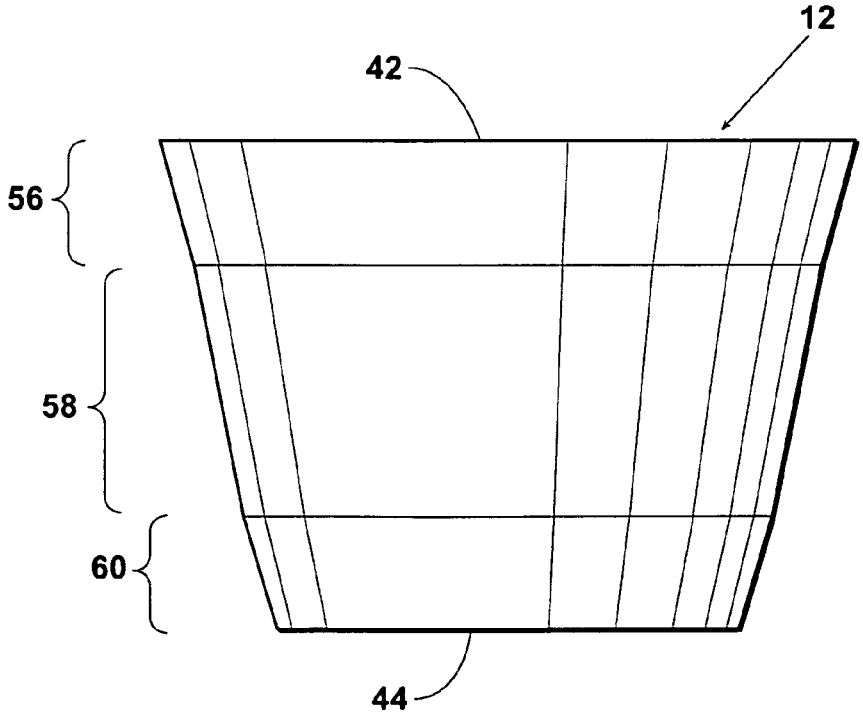
FIG. 5 is a side view of a fuel efficiency enhancement device with a plurality of taper angles.

In yet another embodiment of the conductor 12 shown in FIG. 5, deformation of wall 46 are in the form of a plurality of taper angles $\alpha$ from the inlet 42 to the outlet 44. FIG. 5 illustrates a conductor 12 with three varying angles of taper, including a first taper angle along wall portion 56, a second taper angle along wall portion 58, and a third taper angle along wall portion 60. Preferably, the taper angle along wall portion 56 is about 15 degrees, the taper angle along wall portion 58 is about 11 degrees, and the taper angle along wall portion 60 is about 16 degrees.

Figure 6:
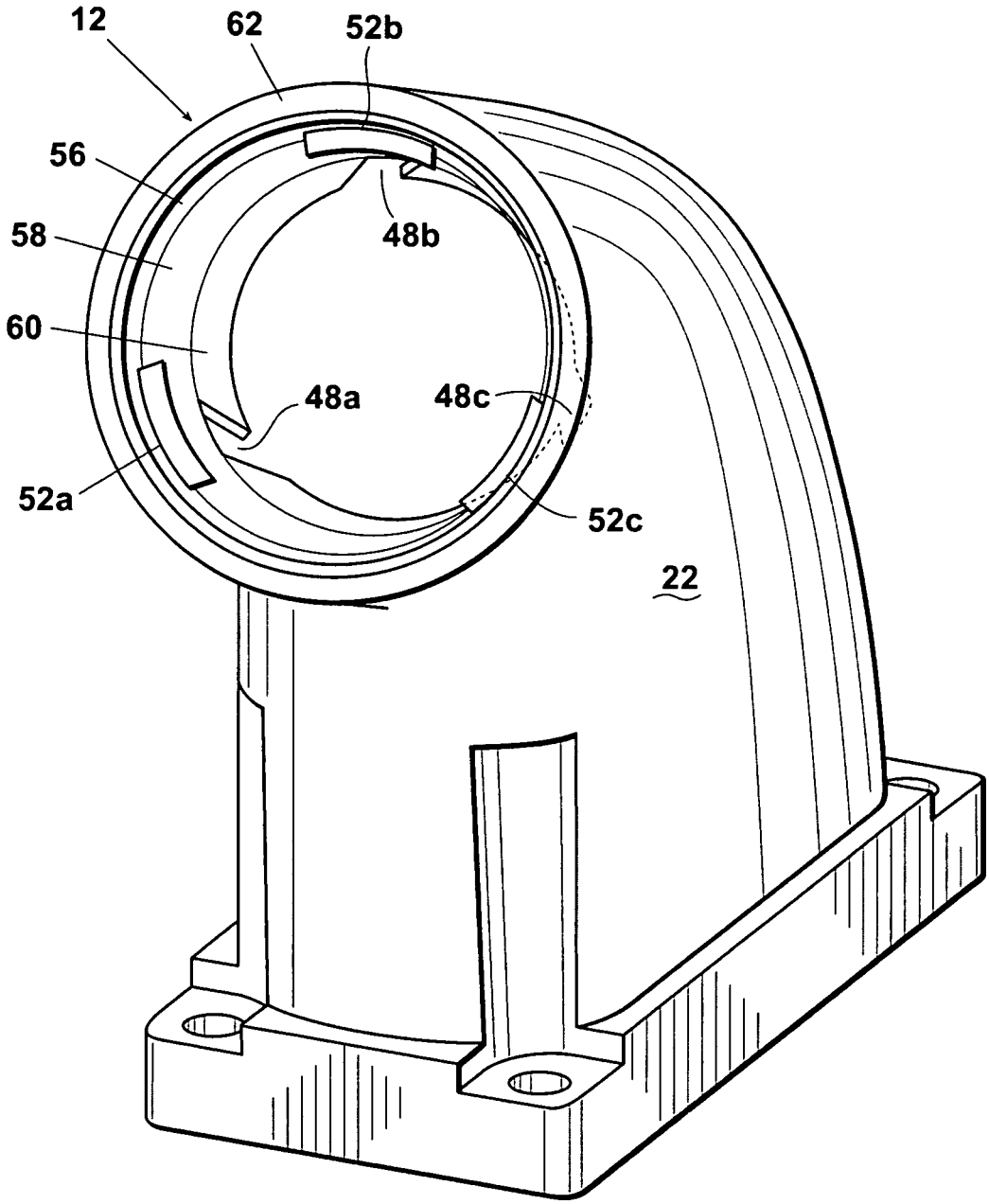
FIG. 6 is perspective view of a fuel efficiency enhancement device installed in the snorkel of a diesel engine according to the invention.

One or more of the above-described wall deformation types may be incorporated into the conductor 12 to beneficially alter one or more characteristics (velocity, direction, pressure) of the flow of gas. For example, FIG. 6 shows a conductor 12 with tabs 52*a-c*, notches 48*a-c*, and varying taper zone portions 56, 58, 60 installed at the inlet of snorkel 22 (FIG. 1). A flange 62 is provided at the inlet 42 of the conductor 12 to facilitate installation. Testing has shown that, for the particular conductor 12 shown in FIG. 6, optimal performance of the conductor 12 is obtained by aligning each of the tabs 52*a-c* with one of the notches 48*a-c* as shown.

Figure 7:
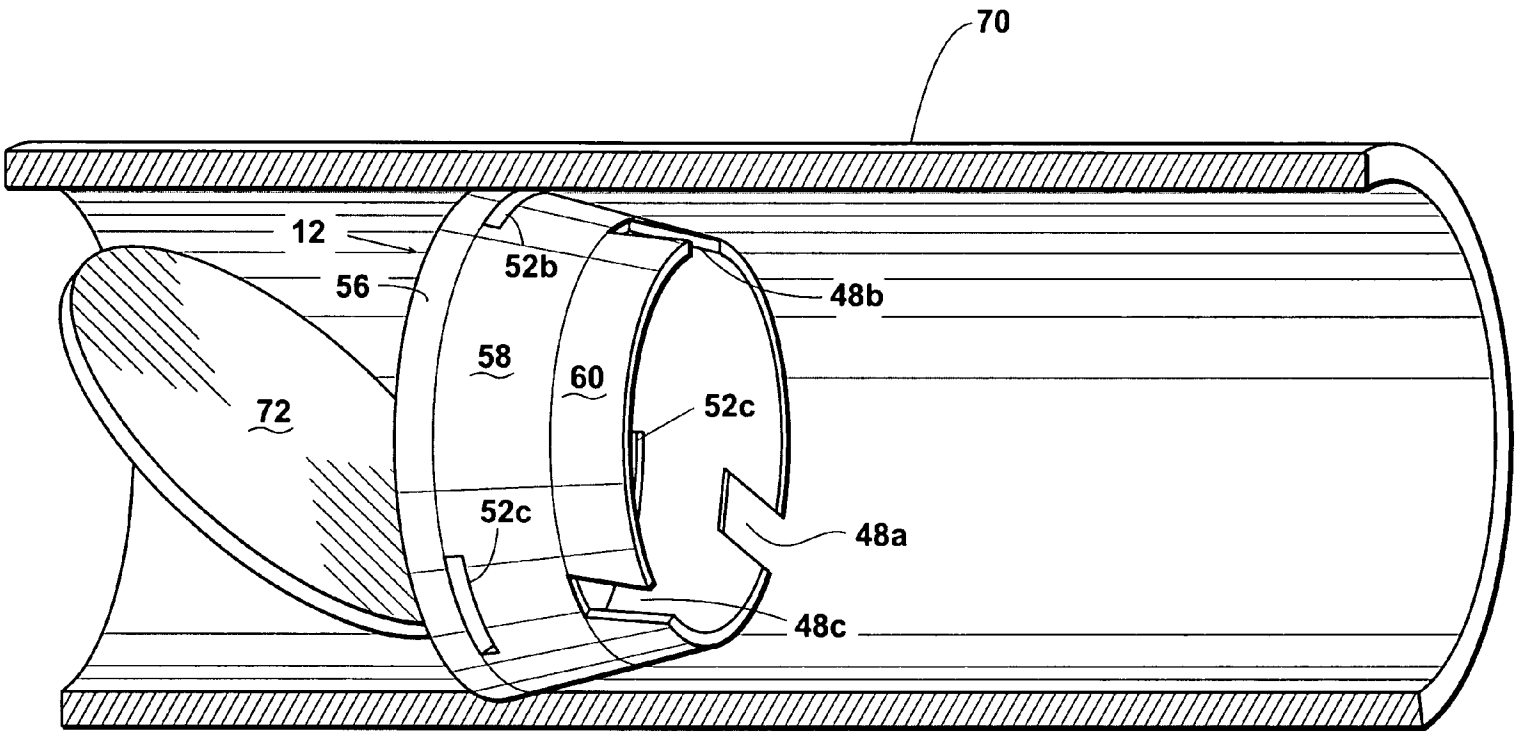
FIG. 7 is a sectional view of a pipe representing an air inlet for a spark ignition engine containing a butterfly throttle valve and a fuel efficiency enhancement device according to the invention.

FIG. 7 shows installation of a conductor 12 with tabs 52*a-c*, notches 48*a-c*, and varying taper zone portions 56, 58, 60 installed in a pipe or duct 70 representing an air intake duct for a spark ignition engine. For this installation, the conductor 12 is positioned immediately downstream of the butterfly throttle valve/plate 72 and upstream from the fuel-air mixer (i.e., fuel injector, etc.).

A preferred angular orientation of the conductor 12 with respect to the butterfly throttle valve/plate 72 is illustrated in FIG. 7. One of the notches, 48*b*, is aligned with the top of the throttle valve/plate 72, which rotates away from the conductor 12 when the butterflow throttle valve/plate 72 is actuated from the closed position to the open position. As a result, the other two notches, 48*b* and 48*c*, are positioned such that the contiguous portion of the conductor 12 between notches 48*b* and 48*c*is aligned with the bottom of the throttle valve/plate 72, which rotates toward the conductor 12 when the butterfly throttle valve/plate 72 is actuated from the closed position to the open position.

As discussed above, the conductor 12 may be advantageously positioned at various points in an IC engine, including inside a duct or other passageway for intake air, a fuel-air mixture, or engine exhaust. Testing has shown an increase in fuel efficiency by positioning the conductor 12 in the exhaust path, which is believed to reduce engine backpressure and thereby increase engine throughput. The conductor 12 enables the engine to combust the fuel-air mixture more completely and thereby reduce emissions, which could ultimately eliminate the need for a catalytic converter. The conductor 12 may also be positioned in the intake and/or exhaust ports of the cylinder block 28 (FIG. 1) to enhance fuel efficiency.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the intention is that defined by the following claims and the full range of equivalency to which each element thereof is entitled.

What is claimed is:

1. An apparatus for enhancing a flow of gas in an internal combustion engine having an air intake system and an exhaust system, said apparatus comprising:

a generally conical-shaped gas flow conditioner having a central axis and a taper angle, said gas flow conditioner being positioned in said flow of gas, said gas flow conditioner including:

an inlet for receiving at least a portion of said flow of gas, said inlet having an opening with an inlet circumference;

an outlet in opposed relation to the inlet for outputting at least a portion of the gas received by the inlet, said outlet having an outlet circumference that is smaller than said inlet circumference;

a wall interconnecting said inlet and outlet, said wall having an inner surface and an outer surface; and a plurality of circumferentially spaced notches, each of which extending from a notch opening at said outlet toward said inlet, for altering one or more characteristics of said flow of gas.

2. The apparatus of claim 1, wherein said notches are symmetrically spaced.

3. The apparatus of claim 1, wherein each of said notches includes two edges extending from the outlet toward the inlet.

4. The apparatus of claim 3, wherein at least one of two edges of one of said notches and at least one of two edges of another one of said notches are not parallel with each other.

5. The apparatus of claim 3, wherein each of two edges for each of said notches is substantially aligned with the central axis of the conditioner.

6. The apparatus of claim 3, wherein at least one of said edges is at an offset angle relative to the central axis of the conditioner.

7. The apparatus of claim 6, wherein said offset angle is in the range of about 25 degrees to about 40 degrees.

8. The apparatus of claim 6, wherein said offset angle is about 30 degrees.

9. The apparatus of claim 1, further comprising:

a plurality of circumferentially spaced tabs formed in said wall intermediate the inlet and the outlet.

10. The apparatus of claim 9, wherein said tabs are symmetrically spaced.

11. The apparatus of claim 10, wherein each of said tabs includes a ramp extending from said wall into the gas flow conditioner to deflect a portion of the gas flowing adjacent the inner surface of the wall.

12. The apparatus of claim 1, wherein said taper angle comprise a plurality of taper angles, each of said plurality of taper angles being associated with a respective portion of said wall.

13. The apparatus of claim 12, wherein said plurality of taper angles includes a first taper angle of about 15 degrees, a second taper angle of about 11 degrees, and a third taper angle of about 16 degrees.

14. The apparatus of claim 1, wherein said one or more characteristics include pressure.

15. The apparatus of claim 1, wherein said one or more characteristics include gas flow direction.

16. The apparatus of claim 1, wherein said engine is a spark-ignition engine with an air intake system having a throttle and fuel-air mixer, wherein said one or more characteristics include gas flow velocity.

17. The apparatus of claim 16, wherein said gas flow conditioner is positioned intermediate the throttle and the fuel/air mixer.

18. The apparatus of claim 1, wherein said gas flow conditioner is positioned in the air intake system.

19. The apparatus of claim 1, wherein said gas flow conditioner is positioned in the exhaust system.

20. An apparatus for enhancing a flow of gas in an internal combustion engine having an air intake system and an exhaust system, said apparatus comprising:

a generally conical-shaped gas flow conditioner having a central axis and a taper angle, said gas flow conditioner being positioned in said flow of gas, said gas flow conditioner including:

an inlet for receiving at least a portion of said flow of gas, said inlet having an opening with an inlet circumference;

an outlet in opposed relation to the inlet for outputting at least a portion of the gas received by the inlet, said outlet having an outlet circumference that is smaller than said inlet circumference;

a wall interconnecting said inlet and outlet, said wall having an inner surface and an outer surface; and a plurality of circumferentially spaced notches formed in said wall adjacent the outlet, wherein each of said notches includes two substantially parallel edges extending from a notch opening at the outlet toward the inlet with each of said edges being at an offset angle relative to the central axis of the conditioner.

21. An apparatus for enhancing a flow of gas in an internal combustion engine having an air intake system and an exhaust system, said apparatus comprising:

a generally conical-shaped gas flow conditioner having a central axis and a taper angle, said flow conditioner being positioned in said flow of gas, said gas flow conditioner including:

an inlet for receiving at least a portion of said flow of gas, said inlet having an opening with an inlet circumference;

an outlet in opposed relation to the inlet for outputting at least a portion of the gas received by the inlet, said outlet having an outlet circumference that is smaller than said inlet circumference;

a wall interconnecting said inlet and outlet, said wall having an inner surface and an outer surface;

a plurality of circumferentially spaced notches formed in said wall adjacent the outlet, each of said plurality of notches extending from a notch opening at said outlet toward said inlet; and a plurality of circumferentially spaced tabs formed in said wall intermediate the inlet and the outlet, each of said tabs being in alignment with one of said notches and having a ramp extending from said wall into the gas flow conditioner to deflect a portion of the gas flowing adjacent the inner surface of the wall.

* * * * *